US009212857B2

(12) United States Patent
Loreman

(10) Patent No.: US 9,212,857 B2
(45) Date of Patent: Dec. 15, 2015

(54) FIREARM MAGAZINE WITH ROUND COUNTING CIRCUIT

(71) Applicant: Todd Fred Loreman, Gardnerville, NV (US)

(72) Inventor: Todd Fred Loreman, Gardnerville, NV (US)

( * ) Notice: Subject to any disclaimer, the term of this patent is extended or adjusted under 35 U.S.C. 154(b) by 0 days.

(21) Appl. No.: 14/214,954

(22) Filed: Mar. 16, 2014

(65) Prior Publication Data

US 2014/0311003 A1 Oct. 23, 2014

Related U.S. Application Data

(60) Provisional application No. 61/803,917, filed on Mar. 21, 2013.

(51) Int. Cl.
*F41A 9/62* (2006.01)

(52) U.S. Cl.
CPC ..... *F41A 9/62* (2013.01)

(58) Field of Classification Search
CPC ..... F41A 9/62
USPC ..... 42/1.02
See application file for complete search history.

(56) References Cited

U.S. PATENT DOCUMENTS

| | | | | |
|---|---|---|---|---|
| 3,552,053 | A | 1/1971 | Jarvis | |
| 5,005,307 | A | 4/1991 | Horne | |
| 5,052,138 | A | 10/1991 | Crain | |
| 5,303,495 | A | 4/1994 | Harthcock | |
| 5,406,730 | A | 4/1995 | Sayre | |
| 5,566,486 | A | 10/1996 | Brinkley | |
| 5,799,432 | A | 9/1998 | Wright | |
| 5,826,360 | A * | 10/1998 | Herold et al. | 42/1.02 |
| 6,094,850 | A | 8/2000 | Villani | |
| 6,590,386 | B1 | 7/2003 | Williams | |
| 7,234,260 | B2 | 6/2007 | Acarreta | |
| 7,356,956 | B2 | 4/2008 | Schinazi | |
| 7,441,491 | B2 * | 10/2008 | Snow | 89/33.02 |
| 8,046,946 | B2 | 11/2011 | Packer | |
| 8,109,023 | B2 | 2/2012 | Pikielny | |
| 8,191,297 | B2 | 6/2012 | Gwillim, Jr. | |
| 8,215,044 | B2 | 7/2012 | Arbouw | |
| 2008/0276517 | A1 | 11/2008 | Acarreta | |
| 2010/0299985 | A1 | 12/2010 | Acarreta | |
| 2011/0252682 | A1 * | 10/2011 | Delgado Acarreta | 42/1.02 |
| 2011/0308125 | A1 | 12/2011 | Gabay | |
| 2012/0167423 | A1 * | 7/2012 | Kindt et al. | 42/1.02 |
| 2014/0250750 | A1 * | 9/2014 | Williams | 42/1.02 |

* cited by examiner

*Primary Examiner* — Bret Hayes
(74) *Attorney, Agent, or Firm* — John W Crosby

(57) ABSTRACT

A device for displaying the number of rounds remaining in a firearm magazine includes a digital counter with a voltage source. A voltage flows from the digital counter, through a magazine connection, and to a follower conductor in the magazine. The follower conductor contacts binary coded conductive strips, which return a binary representation of the number of rounds in the magazine to the digital counter.

1 Claim, 4 Drawing Sheets

FIREARM MAGAZINE WITH ROUND COUNTING CIRCUIT

BACKGROUND OF THE PRESENT DISCLOSURE

1. Field of the Present Disclosure

The present disclosure is directed to a device and system for electronically counting the number of rounds remaining in a firearm magazine and, optionally, displaying the number on a digital display.

2. Related Art

Currently, there is no easy or convenient method to determine the number of rounds remaining in a firearm magazine while holding the firearm in a firing position. A mechanical counter may be added or integrated into the magazine, but checking a mechanical counter requires a shooter to look away from his sights and/or target to check the round count. Other current methods and systems for determining the number of rounds in a magazine require the shooter to lose his sight picture, physically check the magazine, or otherwise disrupt his stance or position.

SUMMARY OF THE PRESENT DISCLOSURE

The present disclosure provides a system for electronically counting the number of rounds in a firearm magazine and, optionally, displaying the number on, e.g., a digital display, which results in a significant increase in convenience and/or situational awareness, as well as other advantages apparent from the discussion herein. Additional features, advantages, and aspects of the present disclosure may be set forth or apparent from consideration of the following detailed description, drawings, and claims. Moreover, it is to be understood that both the foregoing summary of the present disclosure and the following detailed description are. exemplary and intended to provide further explanation without limiting the scope of the present disclosure as claimed.

BRIEF DESCRIPTION OF THE DRAWINGS

The accompanying drawings, which are included to provide a further understanding of the present disclosure, are incorporated in and constitute a part of this specification, illustrate aspects of the present disclosure and together with the detailed description serve o explain the principles of the present disclosure. No attempt is made to show structural details of the present disclosure in more detail than may be necessary for a fundamental understanding of the present disclosure and the various ways in which it may be practiced. In the drawings.

DETAILED DESCRIPTION OF THE PRESENT DISCLOSURE

Figure 1:
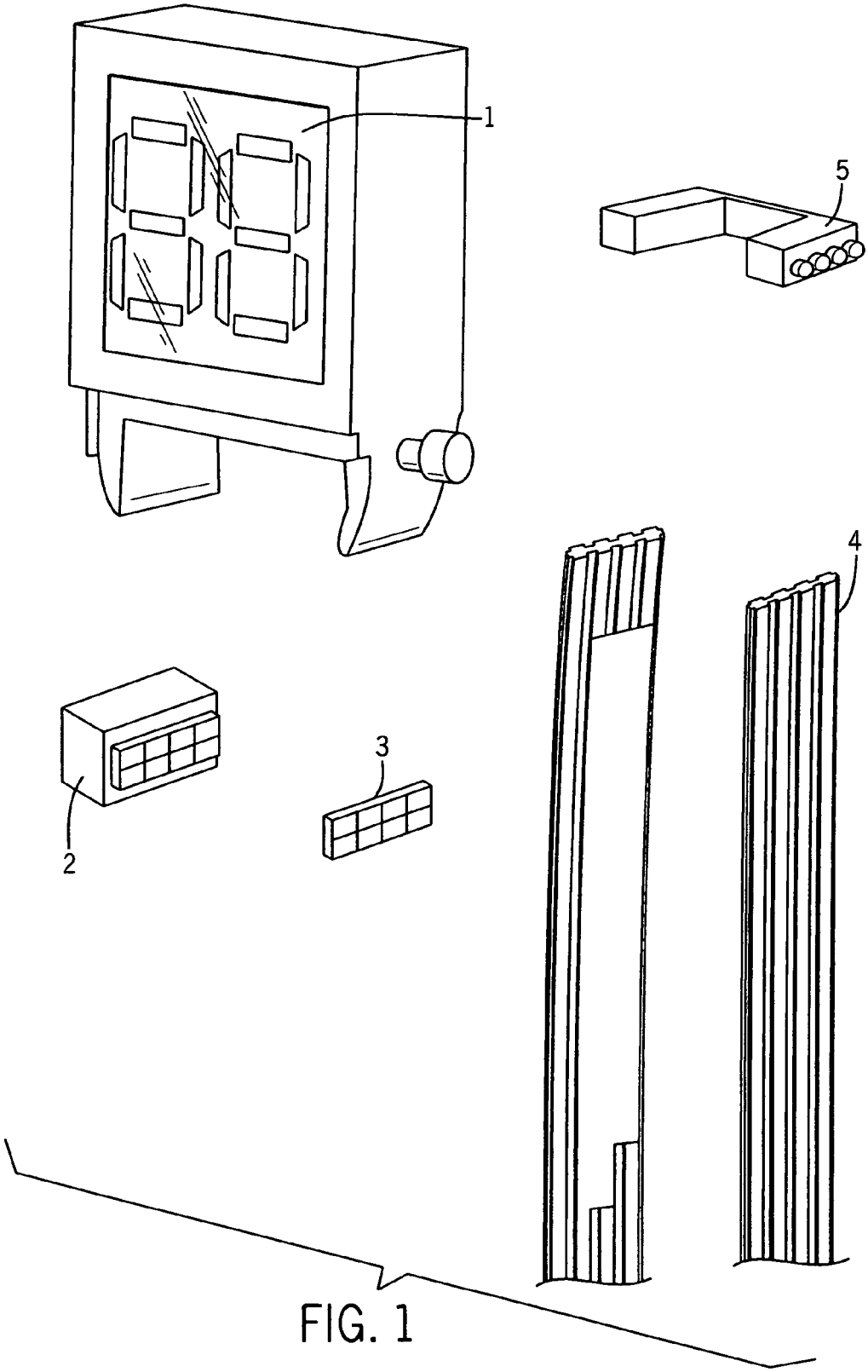
FIG. 1 shows components of a round-counting circuit for a firearm magazine, according to an aspect of the present disclosure.
Figure 2:
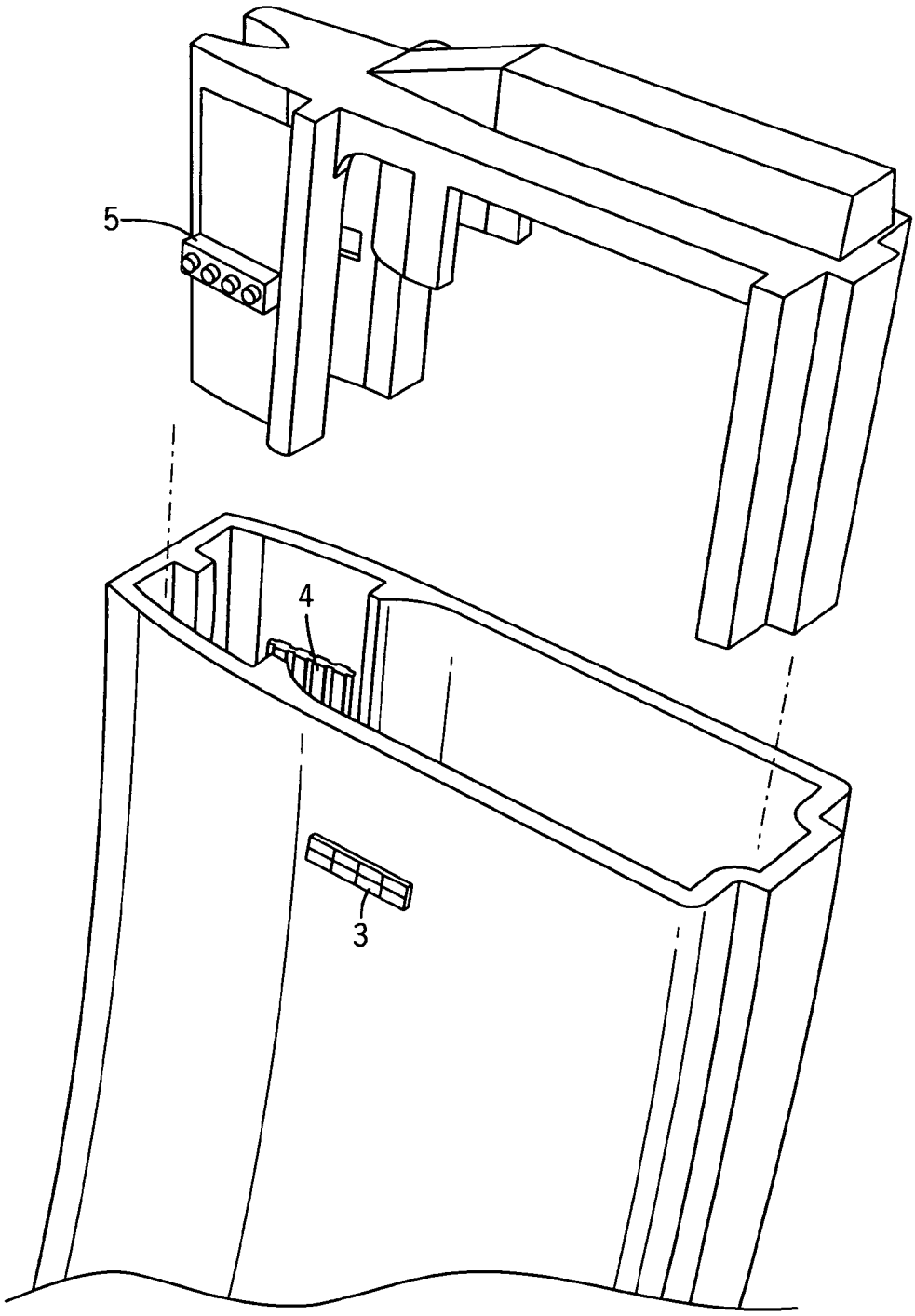
FIG. 2 shows an exemplary magazine and follower with around-counting circuit, according to an aspect of the present disclosure.
Figure 3:
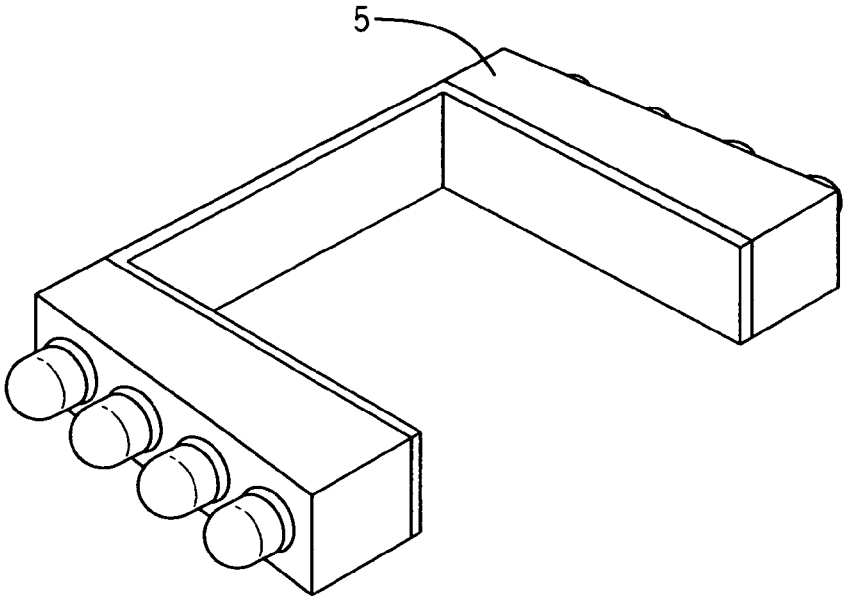
FIG. 3 shows an exemplary follower conductor.
Figure 4:
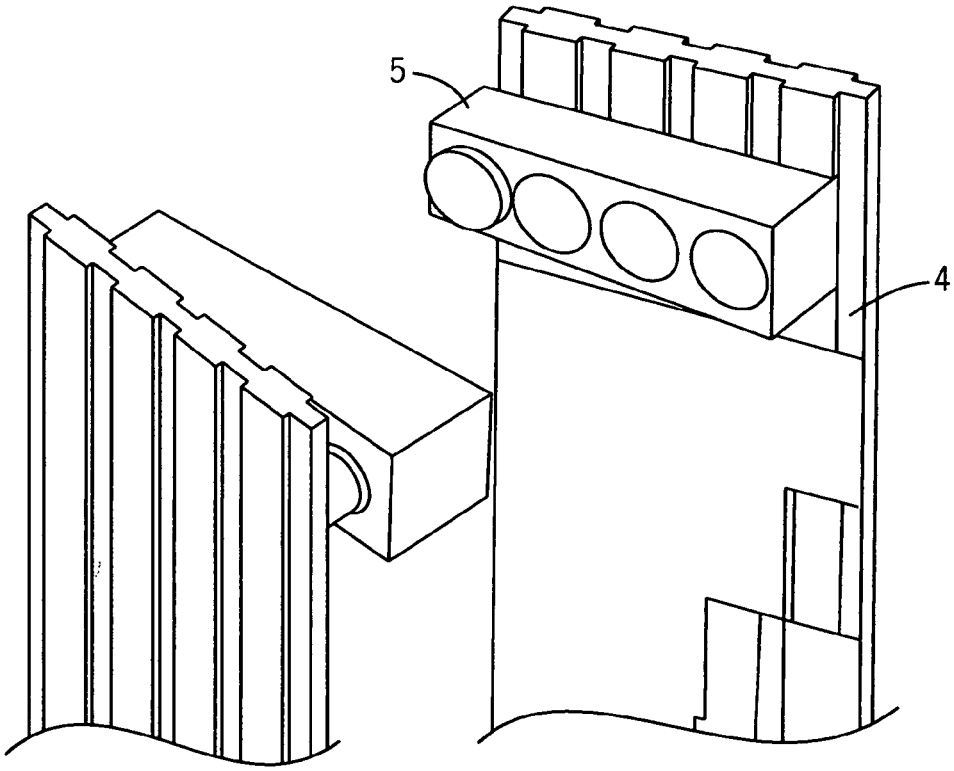
FIG. 4 shows an exemplary follower conductor in contact with a binary conductive strip, according to an aspect of the present disclosure.
Figure 5:
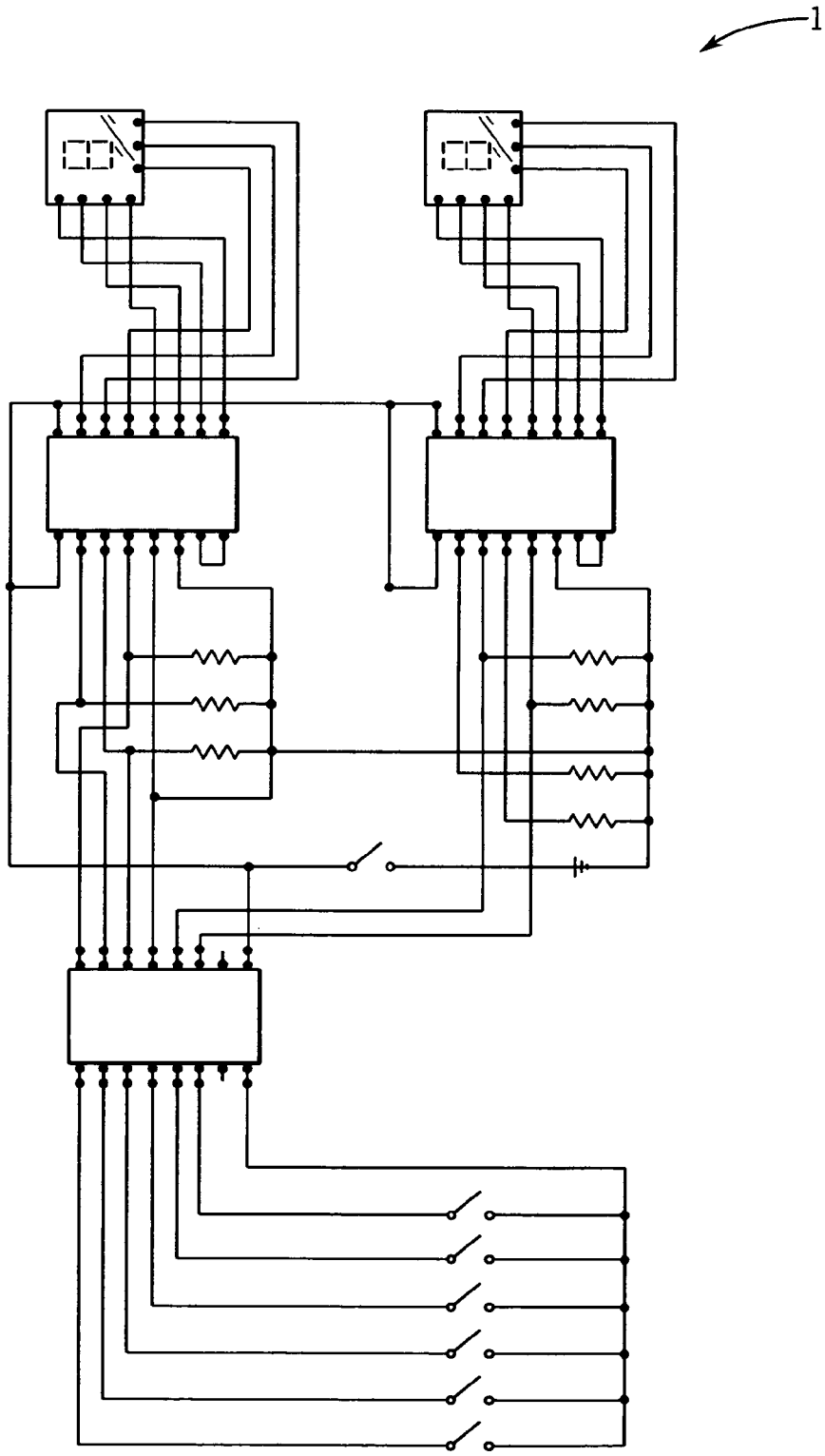
FIG. 5 shows a circuit diagram for a round-counting circuit, according to an aspect of the present disclosure.

The aspects of the present disclosure and the various features and advantageous details thereof are explained more fully with reference to the non-limiting aspects and examples that are described and/or illustrated in the accompanying drawings and detailed in the following description. It should be noted that the features illustrated in the drawings are not necessarily drawn to scale, and features of one aspect may be employed with other aspects as the skilled artisan would recognize, even if not explicitly stated herein. Descriptions of well-known components and processing techniques may be omitted so as to not unnecessarily obscure the aspects of the present disclosure. The examples used herein are intended merely to facilitate an understanding of ways in which the present disclosure may be practiced and to further enable those of skill in the art to practice the aspects of the present disclosure. Accordingly, the examples and aspects herein should not be construed as limiting the scope of the present disclosure, which is defined solely by the appended claims and applicable law. Moreover, it is noted that like reference numerals represent similar parts throughout the drawings.

According to an aspect of the present disclosure, a firearm magazine with a round-counting circuit may include a battery powered LED display 1 that accurately shows the current number of rounds in the magazine. The circuit may include one or more conductive strips 4 that are arrayed in binary format and located inside the magazine. A voltage may flow from the display to one or more conductors 2, 3 that make contact with the magazine. The magazine follower may include one or more conductive contacts 5, which may allow the voltage to flow back through the binary arranged contacts in the magazine and into the display circuit.

The round-counting circuit may include a digital counter, which may include a voltage source. The voltage source may include, for example, a battery, a rechargeable battery, a solar panel, or the like. A voltage may flow from the voltage source to a magazine connection, which may include, e.g., a conductive contact between the firearm and the magazine. From the magazine connection, the voltage may flow to binary conductive strips 4. For example, the voltage may flow to a source strip within a group or set of conductive strips 4. The voltage may travel from the source strip into a follower conductor 5. The follower conductor 5 may be connected or attached to the magazine follower. The follower conductor 5 may include two or more contacts, which may be aligned with one or more corresponding conductive strips. The contact aligned with the source strip may always have an electrical connection to the source strip regardless of the position of the follower. The other contacts may or may not have an electrical connection to the corresponding binary-coded strip 4, depending on the position of the follower. For example, the follower conductor 5 may include six contacts, one of which may be a contact for the source strip. The pattern of electrical connections formed by the other contacts may correspond to a binary representation of a number, and the binary number may correspond to the number of rounds remaining in the magazine as determined by the position of the follower.

The voltage may enter the follower conductor from the source strip, flow through the follower conductor, and return to zero or more of the binary-coded strips, depending on the position of the follower. The binary-coded strips may be connected to the magazine connection. The binary coded strips may include, for example, one or more strips that are separate from the magazine, one or more strips that are woven through the magazine material. The magazine connection 3 may include, e.g., a reader pin array 2. From the magazine connection 3, the voltage may return to the digital counter 1, thereby completing the circuit. In the digital counter 1, the voltage pattern may be read by one or more binary coded decimal integrated circuits, which may display a corresponding base-10 number on an LED display. Alternatively display options may include, for example, an LCD, a computer display, a display in an optic or sight, and so on.

While the present disclosure has been described in terms of exemplary aspects, those skilled in the art will recognize that the present disclosure can be practiced with modifications in the spirit and scope of the appended claims. These examples given above are merely illustrative and are not meant to be an exhaustive list of all possible designs, aspects, applications or modifications of the present disclosure.

What is claimed is:

1. A device for displaying a number indicating how many rounds are in a firearm magazine, the device comprising:

a digital counter comprising a voltage source;

a magazine connector electrically connected to the digital counter;

a source strip electrically connected to the magazine connector;

a plurality of binary coded strips arranged in parallel with respect to each other and electrically connected to the magazine connector; and a follower conductor configured to contact the source strip and the plurality of binary coded strips, the follower conductor configured to be electrically connected to the source strip and the plurality of binary coded strips.

* * * * *